US008754591B2

(12) United States Patent
Ayala et al.

(10) Patent No.: US 8,754,591 B2
(45) Date of Patent: Jun. 17, 2014

(54) LIGHT DIMMER FOR FLUORESCENT LAMPS AND METHODS FOR USE THEREOF

(75) Inventors: Vincente Humberto Aldape Ayala, Nuevo Leon (MX); Ricardo Alejandro Lopez Guajardo, Nuevo Leon (MX); Javier Aldape Domene, Nuevo Leon (MX); Alberto Aldape Domene, Nuevo Leon (MX)

(73) Assignee: Intelliswitch, SA de CV, Monterrey, Nuevo Leon, CP (MX)

( * ) Notice: Subject to any disclaimer, the term of this patent is extended or adjusted under 35 U.S.C. 154(b) by 479 days.

(21) Appl. No.: 13/226,253

(22) Filed: Sep. 6, 2011

(65) Prior Publication Data

US 2013/0057154 A1 Mar. 7, 2013

(51) Int. Cl.
*H05B 37/02* (2006.01)
*H05B 41/38* (2006.01)

(52) U.S. Cl.
USPC ..... 315/307; 315/105; 315/112; 315/308; 315/DIG. 4

(58) Field of Classification Search
CPC .... H05B 37/00; H05B 37/02; H05B 37/0209; H05B 41/00; H05B 41/02; H05B 41/04; H05B 41/044; H05B 41/06; H05B 41/10; H05B 41/14; H05B 41/16; H05B 41/23; H05B 41/36; H05B 41/38; H05B 41/382; H05B 41/386; H05B 41/388; H05B 41/39; H05B 41/391
USPC ..... 315/DIG. 4, 114, 116, 115, 113, 112, 315/107, 106, 105, 94, 219, 291, 307, 308
See application file for complete search history.

(56) References Cited

U.S. PATENT DOCUMENTS

| | | | | |
|---|---|---|---|---|
| 4,894,587 | A * | 1/1990 | Jungreis et al. | 315/200 R |
| 4,950,963 | A | 8/1990 | Sievers | |
| 6,124,684 | A | 9/2000 | Sievers | |
| 6,329,767 | B1 | 12/2001 | Sievers | |
| 7,242,154 | B2 * | 7/2007 | Rudolph | 315/291 |
| 7,336,041 | B2 | 2/2008 | Ayala et al. | |
| 7,432,661 | B2 * | 10/2008 | Taipale et al. | 315/209 R |
| 7,759,879 | B2 | 7/2010 | Ayala et al. | |

OTHER PUBLICATIONS

U.S. Appl. No. 12/840,108, filed Jul. 20, 2010, entitled "Automatic Calibration of an Automated Dimmer," 11 pages of text, 10 pages of drawings.
U.S. Appl. No. 61/365,937, filed Jul. 20, 2010, entitled "Automatic Calibration of an Automated Dimmer," 3 pages of text, 3 pages of drawings.

* cited by examiner

*Primary Examiner* — David H Vu
(74) *Attorney, Agent, or Firm* — Haynes and Boone, LLP; William B. Nash; Joseph Mencher

(57) ABSTRACT

A device to control luminosity of a lamp supported by a rapid start ballast, the device including a first terminal and a second terminal configured to be connected in series with the rapid start ballast and the lamp, a current divisor array, in connection with the first terminal and the second terminal, with a plurality of inductors and a commutable element, the commutable element selecting between two current paths employing the plurality of inductors, the commutable element when in a first state selecting a first one of the current paths to provide a higher luminosity setting and when a second state selecting a second one of the current paths to provide a lower luminosity setting, and a transformer in connection with the first terminal and the second terminal configured to provide heating to an electrode of the lamp.

20 Claims, 4 Drawing Sheets

LIGHT DIMMER FOR FLUORESCENT LAMPS AND METHODS FOR USE THEREOF

TECHNICAL FIELD

The present disclosure is related devices and methods for use with rapid start ballasts for fluorescent lamps to provide illumination intensity control.

BACKGROUND

Rapid start fluorescent lamps are very popular for lighting purposes, especially in offices, work places, business and homes. Rapid start ballasts offer some technical advantages over the instant start ballast, such as an increase in lamp life expectancy because the turn on process of the rapid start ballast causes less deterioration in the lamps. Rapid start ballasts achieve the lighting of the lamps by heating the filaments in the lamp terminals using a current so that an electrical flow may begin through the fluorescent tube.

Ballasts, such as rapid start ballasts, control the intensity of the electrical flow through the lamp at a nearly constant value and allow an intense luminosity which is close to the nominal power of the lamps used.

Some rapid start ballasts are designed to allow control of the illumination intensity using elements such as light sensors, presence sensors, or other devices outside of the ballast. The aforementioned is performed by incorporating these elements to regulate the electrical flow of the lamp, where the electrical current affects the luminous intensity of the lamp.

In one conventional approach, a rapid start ballast has an entry port to turn on or off selected lamps in an array of lamps. By selectively turning on or off ones of the lamps, the ballast controls the total luminosity of the array of lamps. However, this approach changes the lighting pattern of the array of lamps, losing uniformity in the intensity in the illuminated area.

In another conventional approach, a rapid start ballast provides control of illumination intensity though use of a frequency variation element. In one example, a rapid start ballast contains an element that regulates the current which flows through the lamps with a frequency variation technique. The frequency variation technique moves an operating frequency closer or farther away from a resonance frequency to control the luminous intensity of a lamp. Another conventional technique includes changing the relation of the current amplitude in the two half cycles of a sinusoidal waveform, regulating the current and the luminosity.

There is a need for an efficient and effective way to provide luminosity control for a fluorescent lamp installed with a rapid start ballast.

BRIEF SUMMARY

Various embodiments include a device for use with a rapid start ballast to allow for luminosity control of one or more lamps supported by the rapid start ballast. Various embodiments also include methods for controlling the luminosity of such lamps.

One example embodiment includes a device to dim the light of a lamp supported by a rapid start ballast. The device includes a control mechanism to dim the intensity of the light. The control mechanism executes a luminosity adjustment in response to, e.g., the external light detected by an illumination sensor in the area, a presence detected by movement sensors, a selection element for manual dimming, and/or the like. The device can be retrofitted to a rapid start ballast that was originally not designed for dimming. Thus, some embodiments include a device, separate from the ballast, which can be installed with the ballast (as described further below) to control luminosity of a fluorescent lamp.

Further in this embodiment, the example device includes a magnetic element with a current divisor array and with exit ports in communication with the current divisor array. The current devisor array can be used to select various combinations of ports which correspond to two or more levels of light intensity in the fluorescent lamps. Further in this example, the ballast provides the lamps with an electrical flow of proportions no greater than one (but less than one when dimmed) with respect to the nominal capacity of the lamp. Such electrical flow can be achieved by providing an appropriate number of turns in the magnetic element for each one of the individual ports.

The example device further includes a commutable element to select exit ports of the magnetic element, where a set of exit ports corresponds to a respective dimming level, and where at least two different sets of ports can be selected.

In one aspect, embodiments of the disclosure control the lighting level in rapid start ballasts for fluorescent lamps that were not originally designed for dimming.

The aforementioned is achieved by using a commutable transformer with a relation in its coils that changes the charge to the ballast, in relation to the current of the transformer, and while also maintaining current sufficient for turn on of the filaments of the lamp. The luminous intensity corresponds to the transformer's own current, which is commutable, and the luminous intensity may be adjusted in or more steps.

In another aspect, embodiments of the disclosure incorporate characteristics which contribute to energy savings in illumination systems without making changes to the electrical circuits of the ballast or the lamps.

In one example, the device can be connected to light and presence sensors, manual or automatic switches, or other means to control the intensity of light as appropriate for a desired application.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION

Figure 1:
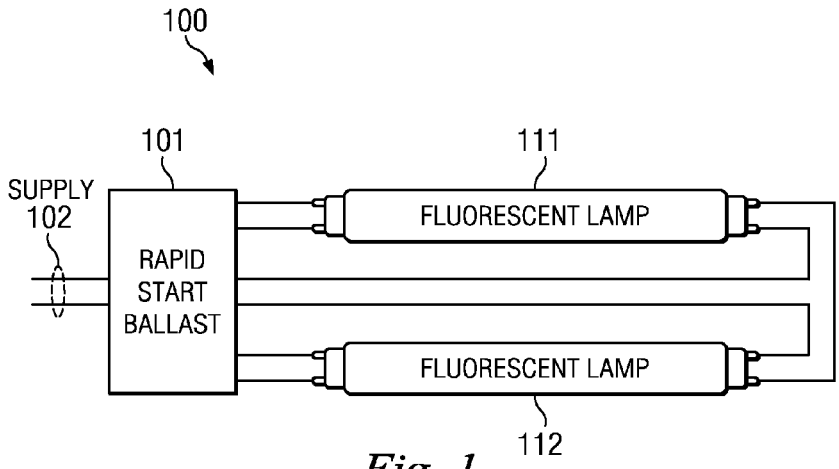
Fig. 1 (PRIOR ART)
FIG. 1 is a connection diagram of a rapid start ballast with its lamps according to conventional techniques.

FIG. 1 is an illustration of a conventional assembly 100 including a rapid start ballast 101 and two fluorescent lamps 111, 112. Rapid start ballasts are known in the art, and a typical rapid start ballast heats the cathodes of the lamps, even during normal operation of the lamps, where normal operation refers to an on-state following start-up. In contrast to some conventional instant start ballasts, rapid start ballasts do not produce a voltage spike at power-on. This property of rapid start ballasts can prolong lamp life, even while allowing quick start-ups.

Referring to FIG. 1, a conventional connection diagram of rapid start ballast 101 is shown. Rapid start ballast 101 is in electrical communication with power supply 102, which may include 120V at 60 Hz, though other voltages and frequencies can be used with various ballasts. Rapid start ballast 101 converts the input power to a different voltage and regulates the current output to lamps 111, 112 to provide appropriate power to lamps 111, 112. The conventional connection shown in FIG. 1 has some disadvantages. For instance, assembly 100 provides no way to control a luminosity of lamps 111, 112. Thus, during normal operation, lamps 111, 112 are either on or off and have only one luminosity setting.

Figure 2:
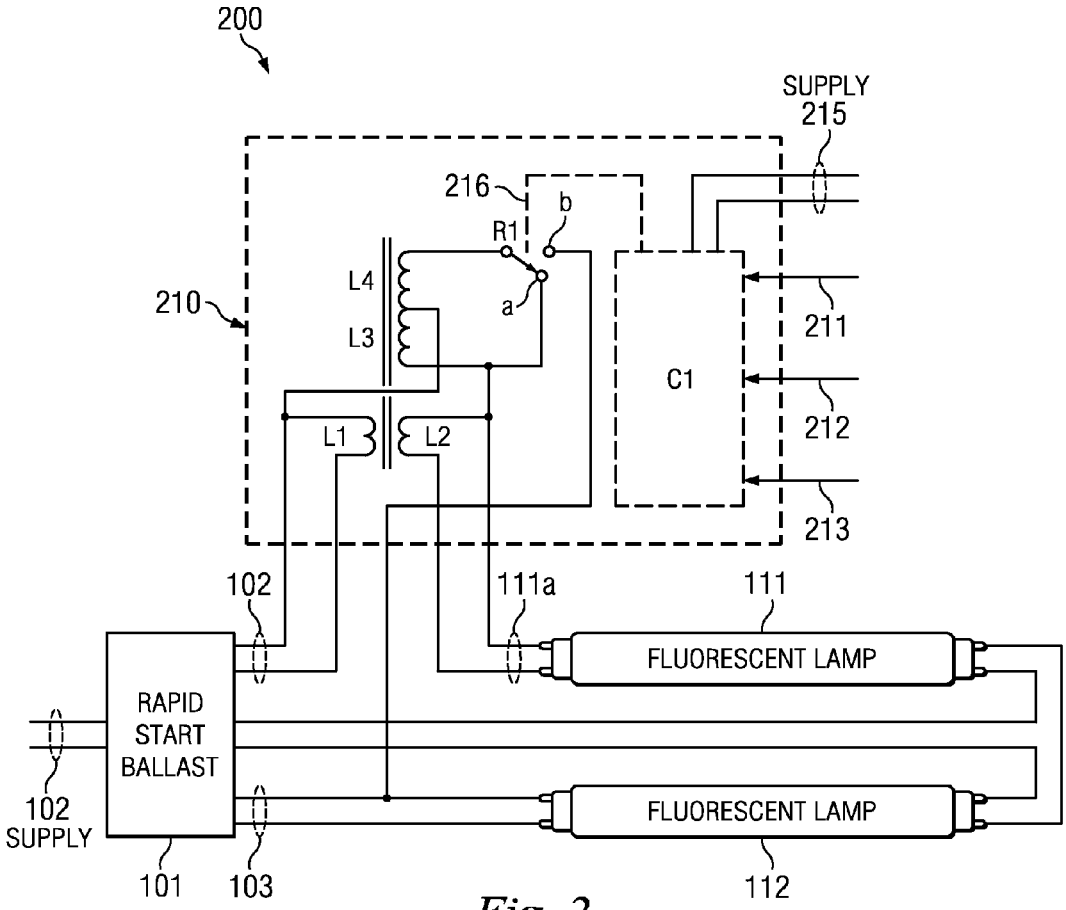
FIG. 2 is an example connection diagram of a rapid start ballast and lamps electrically connected with an example device, adapted according to one embodiment, to provide luminosity adjustment of the lamps.

FIG. 2 is an illustration of assembly 200, adapted according to one embodiment, which provides a dimming function, as explained in more detail below. The rapid start ballast 101 is connected to lamp 112 as originally described with respect to FIG. 1. Lamp 111 has its right terminal connection to lamp 112 also as shown with respect to FIG. 1. Luminosity control device 210 is inserted in series between lamp 111 and ballast 101, so that lamp 112, lamp 111, and device 210 are connected in series to ballast 101. As explained in more detail below, device 210 can change the current flowing through lamps 111, 112, thereby adjusting a luminosity of lamps 111, 112.

Figure 3:
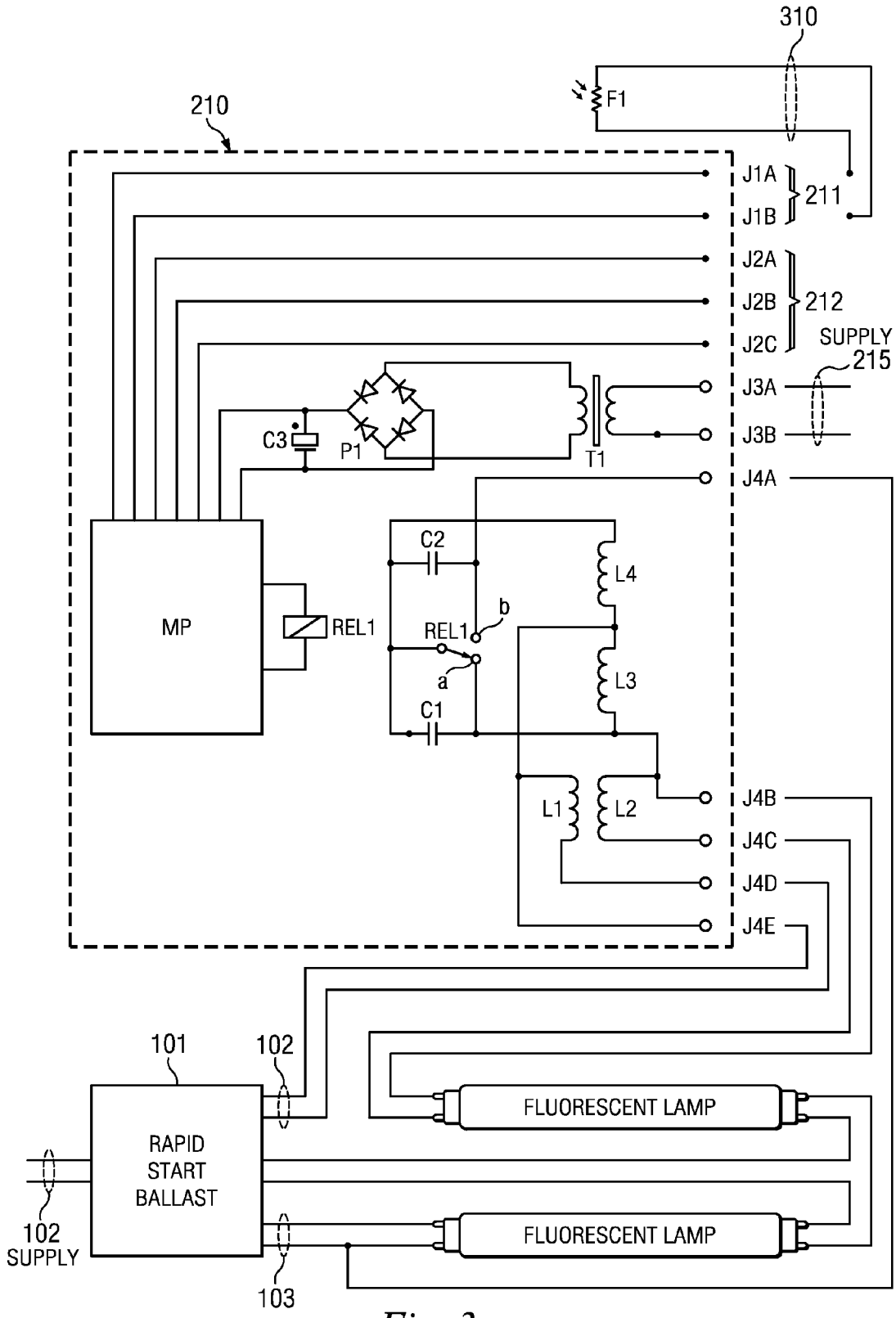
FIG. 3 is an example circuit diagram according to one embodiment, providing luminosity control according to a signal from a light sensor or other device.
Figure 4:
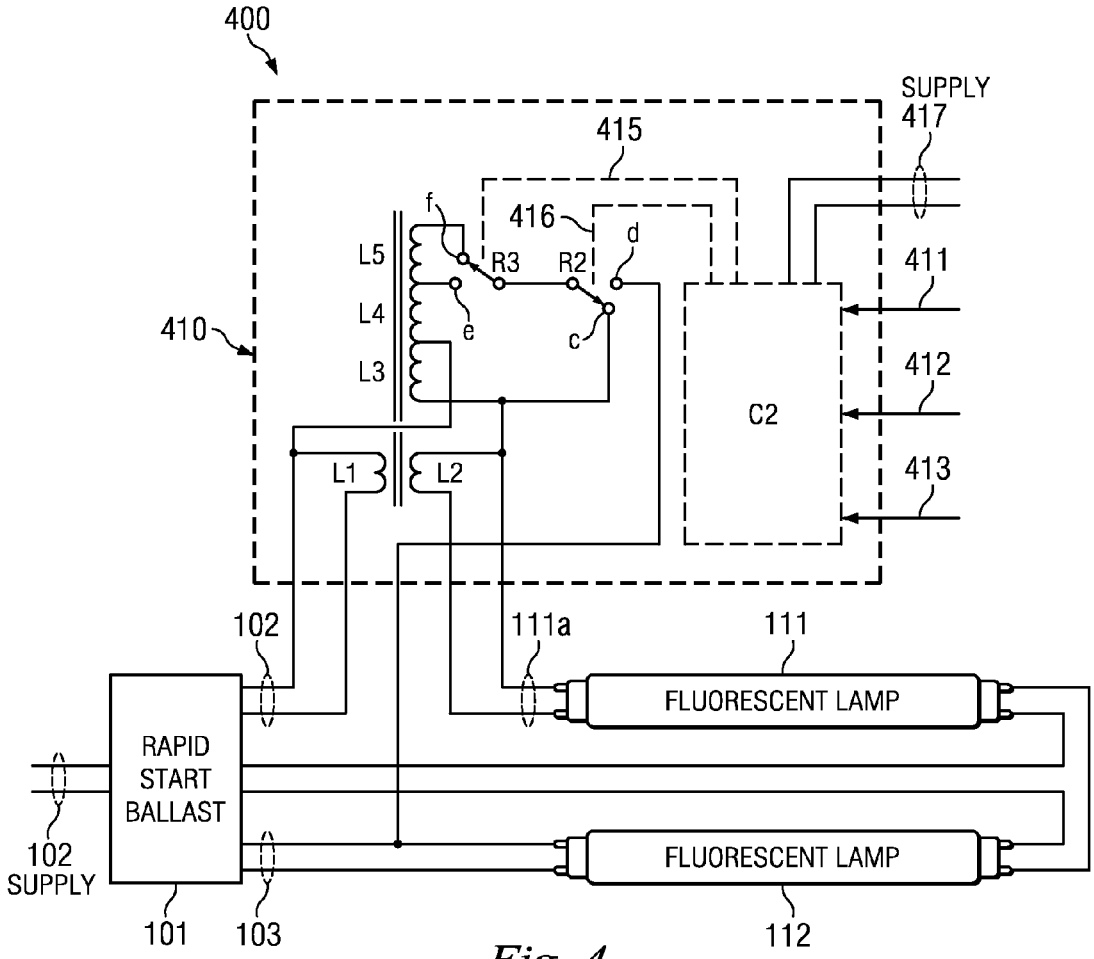
FIG. 4 is an example connection diagram of a rapid start ballast and lamps electrically connected with an example device, adapted according to one embodiment, to provide luminosity adjustment of the lamps.

It should be noted that while the examples of FIGS. 2-4 show arrangements including two fluorescent lamps, the scope of embodiments is not so limited. Various embodiments may be adapted for use with one, two, three, or more lamps, as appropriate for a given application.

The ballast lines 102 which supply the terminals 111*a* of lamp 111 in FIG. 1, are connected to device 210. Lines 102 directly excite the coil L1 (in this example, an inductor), which is inductively coupled to (and forms a transformer with) coil L2. Coil L2 supplies the terminals 111*a* with current to heat the filament (not shown) in lamp 111.

FIG. 2 shows one state of the device 210 when relay R1 is in contact with terminal a. One of the two output lines 102 of the ballast 101 is connected between the coils L3 and L4. One terminal of the coil L4 is connected to the relay unit R1 and its terminal which is in close contact (in unit R1) is connected to a terminal of the coil unit L3. In this state of contact of the relay R1, a conduction state occurs without opposing the electrical flow through the coils L3 and L4, thereby not decreasing the current through device 210. In this state, lamps 111 and 112 turn on at 100% of the level which would normally be supplied by ballast unit 101 in the absence of device 210.

The other state of device 210 is when relay R1 is in electrical contact with terminal b. In this state one of the terminals 103 of the lamp 112 comes in contact with the coil L4 through the relay R1. In this state, the magnetic interaction of coils L3 and L4 causes a current reduction. In another aspect, some current from device 210 is shunted to terminal 103, thereby decreasing the current that flows serially through lamps 111, 112. The decrease in current results in a dimming of lamps 111, 112.

The amount of current reduction depends, at least partially, on the number of turns in coils L3 and L4. Generally, the reduction proportion may be according to equation 1.

$$\text{Level of reduction} = L3 \text{ turns}/\text{sum}(L3 \text{ and } L4 \text{ turns}). \qquad \text{Eq. 1}$$

Device 210, therefore, provides two luminosity settings. One setting is at 100% of the level which would normally be supplied by ballast 101 (i.e., the level that would be provided by the set-up of FIG. 1). The other setting provides a lower level of luminosity. The settings can be applied during operation of the lighting device 200 manually or automatically.

The device 210 has a dimming control unit C1, which has ports 211-213 which may be connected to one or more input devices, including, e.g., motion sensors, light sensors, manual inputs, and the like. Signals at ports 211-213 may control a selection of a luminosity level for lamps 111, 112. In one manual example, a human user selects a brighter or dimmer state. In one automatic example, a light sensor adjusts a luminosity depending on a level of ambient light. In another automatic example, a motion sensor selects the higher luminosity setting only when it detects a person in the room. However, the scope of embodiments is not limited to the examples provided above. Various embodiments may receive input control signals from any type of device now known or later developed and may, therefore, be controlled in any desirable manner.

The control unit C1 is powered by an electrical source 215. Control unit C1 has an output 216 that physically controls relay unit R1 to be in contact with port a or b to select the dimming intensity in the lamps 111, 112.

FIG. 3 is an illustration of an exemplary circuit diagram for the embodiment shown in FIG. 2. FIG. 3 is a diagram of an application circuit with a level of dimming controlled by signals received at ports 211, 212, which may be from a light sensor, a movement sensor, a manual switch, or the like. An example light sensor 310 is shown FIG. 3.

The electrical supply 215 for the device 210 is connected to terminals J3A and J3B to a transformer T1 to step down the voltage. The stepped down voltage is then rectified by rectifier unit P1 and filtered through a capacitor C3. In this manner MP1 unit is energized by a regulated DC voltage.

Microcontroller unit MP1 has the function of processing signals from ports 211, 212, and controlling relay unit R1 in response thereto. MP1 includes a logic circuit that executes software and/or firmware to process signals from ports 211, 212 appropriately. MP1 receives signals from ports 211, 212, determines an appropriate luminosity setting, and actuates relay R1 to select the luminosity setting. During actuation of the relay R1, MP1 causes a reduction effect of at least one of the capacitors C1 and C2, which in turn allows for a commutable reduction, therefore the transitory peaks in the relay unit R1 when it connects to the exit line of the ballast in contact with the terminal of the lamp unit 3 in terminal J4A to the coil unit L4.

The coil units L3 and L4 work as a current divider by means of a magnetic effect. In another way of viewing the operation of device 210, the selection of a port a, b by relay R1 changes the current paths within device 210, thereby affecting the amount of current that flows through lamps 111, 112. When relay R1 selects port a, coils L3 and L4 are connected to form a loop, and the maximum allowable current flows through lamps 111, 112 at ports J4B, J4C (no current flows at port J4A).

When relay R1 selects port b, some of the current is shunted via port J4A to terminals 103. In this state, less than the maximum allowed current flows through lamps 111, 112. Thus, device 210 acts as a current divider, in one aspect, by dividing the current among sets of ports including 1) ports J4B and J4C and 2) J4A, J4B, J4C.

The coil units L1 and L2 are designed to maintain the heating current in the filament (not shown) of lamp 111 connected at terminals J4B and J4C. Inductor L1 is the primary winding, and inductor L2 is the secondary winding, connected to terminals J4D, J4E. Ballast 101 supplies current to terminals J4D, J4E, and the transformer formed by L1 and L2 adjusts the amount of current according to the respective numbers of turns in L1 and L2.

In some embodiments, MP1 of device 210 turns the lamps 111, 112 on at 100% of the ballast power to obtain an efficient lamp switch on, regardless of the signals from the motion or light sensors, manual or automatic manipulation. After a sufficient time, the luminosity setting may be changed to less than 100%, if instructed.

FIGS. 2-4 show an embodiment that includes one commutable element (relay R1) to provide two different luminosity settings in a system with a rapid start ballast. The principles explained above may be scaled to two or more commutable elements in order to provide additional luminosity settings. FIG. 4 is an illustration of an embodiment that includes two commutable elements, relays R2 and R3.

FIG. 4 shows lighting assembly 400, adapted according to one embodiment. In FIG. 4, luminosity control device 410 is connected to ballast 101 and lamp 111 in the same manner as shown above with respect to FIG. 2. However, luminosity control device 410 includes an additional relay and an additional inductive coil L5 (on a common core with L3 and L4) to provide an additional level of dimming.

Controller C2 receives input signals from ports 411-413, which may be same as or similar to the signals described above with respect to ports 211-213 of FIG. 2. Control unit C2 adjusts the luminosity setting in response to the signals at ports 411-413 by outputting signals at 415, 416 to select conductive paths at relays R2, R3. Relay R2 selects between ports c and d, whereas relay R3 selects between ports e and f.

Control unit C2 operates in a manner similar to that discussed above for control unit C1 at FIG. 2, but with the added complexity to select additional luminosity settings. Device 410 is powered by supply 417.

In FIG. 4, relay R2 selects port c, and relay R3 selects port f, which creates a loop including inductors L3-L5. When relay R3 selects port f, current flows through inductor L5, and when relay R3 selects port e, no current flows though L5. When relay R2 selects port c, a loop is created that includes L3, L4, and perhaps L5. When relay R2 selects port d, some current is shunted to terminal 103, thereby decreasing the current that flows through lamps 111, 112.

When relay R3 selects port e, the two luminosity settings (provided by the selection at relay R2) are the same as described above with respect to FIG. 2, including the relationship shown as equation 1.

When relay R3 selects port f, two luminosity setting can be achieved by switching relay R2. When relay R2 selects port c, the luminosity setting is about 100%. When relay R2 selects port d, the reduction in current through the lamps 111, 112 can be calculated using equation 2 below.

$$\text{Level of reduction}=L3\text{ turns}/\text{sum}(L3,L4\text{ and }L5\text{ turns}). \qquad \text{Eq. 2}$$

Figure 5:
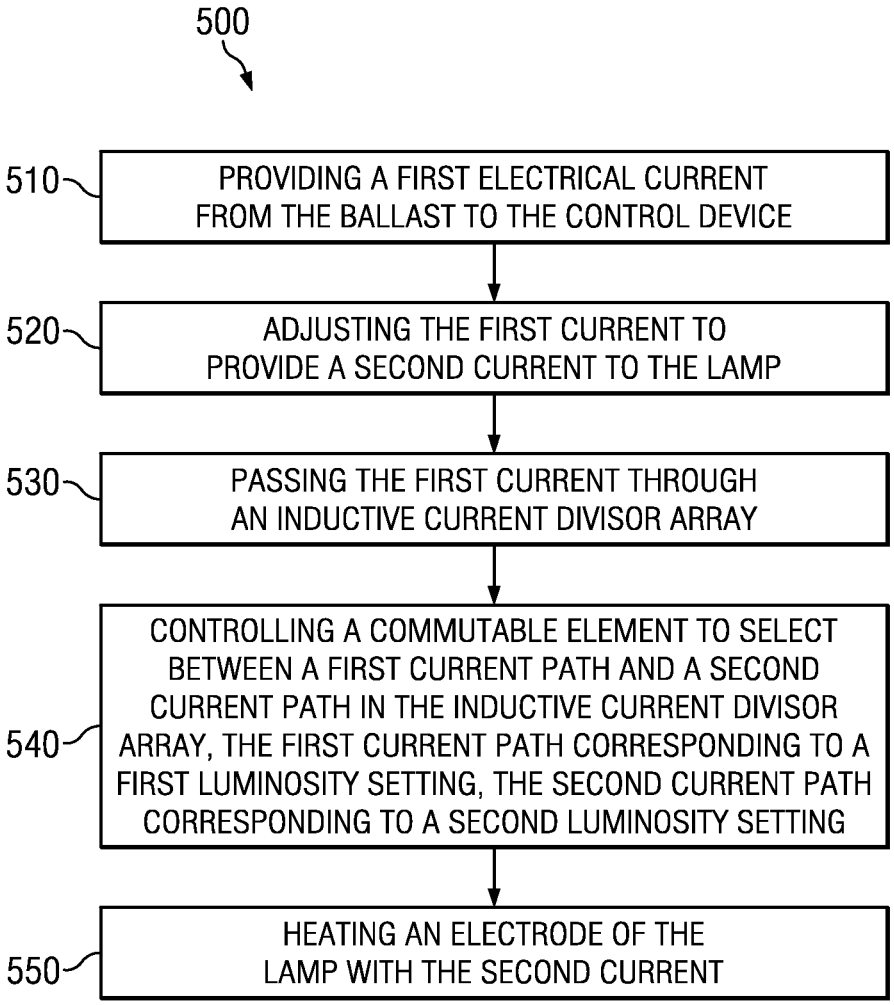
FIG. 5 is an illustration of an exemplary method for providing luminosity control, according to one embodiment.

FIG. 5 is an illustration of exemplary method 500, adapted according to one embodiment. Method 500 is a method for controlling luminosity in a lighting assembly that includes a rapid start ballast and a plurality of lamps in series with a luminosity control device, such as illustrated in FIGS. 2 and 4. One or more of the actions of method 500 may be performed by the luminosity control device as its controller executes computer readable code stored, e.g., in external or internal memory, as software and/or firmware.

In block 510, the ballast provides a first electrical current to the luminosity control device. The luminosity control device adjusts the first current to provide a second current to the lamps in block 520. Blocks 530 and 540 illustrate one example technique to provide the second current to the lamps.

In block 530, the first current is passed to an inductive current divisor array. An example of an inductive current divisor array is shown in FIG. 2 including L3 and L4 and in FIG. 4 including L3-L5. Further in this example, the current divisor array is coupled with a commutable element, such as a relay, to select one or more current paths using the current divisor array. A microcontroller or other logic device controls the commutable element to select between the current paths.

In block 540, the commutable element selects between the first current path and the second current path. The first current path corresponds to a first luminosity setting (and a first level for the second current), and the second current path corresponds to a second luminosity setting (and a second level for the second current). Generally, a smaller value for the second current corresponds to a lower luminosity setting. In some embodiments, such as that shown above in FIG. 4, the commutable element includes more than one relay or other switching device to select between three or more current paths and three or more luminosity settings.

In block 550, the second current is used to heat an electrode in at least one of the lamps. In some embodiments, the electrode is heated, even during normal operation.

The scope of embodiments is not limited to the specific actions shown in FIG. 5. Other embodiments may add, omit, rearrange, or modify one or more actions as appropriate. For instance, some embodiments include receiving a signal from a sensor or manual switch at the control device that indicates a selection of a luminosity setting. The control device can then select one of the luminosity settings in response to the signal.

Various embodiments provide one or more advantages over the configuration shown in FIG. 1. For instance, some embodiments add control characteristics to rapid start ballasts for fluorescent lamps, which offers the possibility of selecting the lighting level.

In some instances, a retrofit of one of the above-described devices to a conventional lamp does not employ additional wiring for control, and its connection can be made in a simple and quick manner. Thus, in such instances, a relatively small investment can be made to adopt energy savings in an existing illumination system for the control of fluorescent lamps with rapid start ballasts. This can be especially true where the cost of ballast is higher than the cost of a retrofitted dimmer device.

In some embodiments, such as those shown in FIGS. 2-5, the devices 210, 410 do not change the power factor of the ballasts and do not cause any additional harmony distortion to the ballast. Furthermore, with appropriate sizing of coils L1 and L2, various embodiments turn on the lamps without any reduction in illumination.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claim:

1. A device to control luminosity of a lamp supported by a rapid start ballast, the device comprising:

a first terminal and a second terminal configured to be connected in series with the rapid start ballast and the lamp;

a current divisor array, in connection with the first terminal and the second terminal, with a plurality of inductors and a commutable element, the commutable element selecting between two current paths employing the plurality of inductors, the commutable element when in a first state selecting a first one of the current paths to provide a higher luminosity setting and when a second state selecting a second one of the current paths to provide a lower luminosity setting; and a transformer in connection with the first terminal and the second terminal configured to provide heating to an electrode of the lamp.

2. The device of claim 1 further comprising:

a control unit to cause the commutable element to select between the first and the second current path.

3. The device of claim 2 in which the control unit comprises:

an input port to receive a control signal indicating a selection of either the higher or lower luminosity setting; and logic to actuate the commutable element in response to the control signal.

4. The device of claim 3 further comprising at least one of the following items in connection with the input port to provide the control signal:

and illumination sensor;

a movement sensors; and a manual dimming element.

5. The device of claim 1 in which the commutable element comprises a relay.

6. The device of claim 1 in which the higher luminosity setting provides an electrical current in the lamp no greater than a nominal capacity of the lamp.

7. The device of claim 1 in which the current divisor array comprises three coils on a common core, and further in which the commutable element comprises a first relay to select or deselect one of the coils and a second relay to select between a loop including the three coils and a shunt path.

8. The device of claim 7 providing an additional luminosity setting between the higher luminosity setting and the lower luminosity setting.

9. The device of claim 1 which the current divisor array comprises two coils on a common core, and further in which the commutable element comprises a relay to select between a loop including the two coils and a shunt path.

10. A method for providing luminosity control in a lighting assembly that includes a lamp placed in series with a control device, the lamp being in electrical connection with a ballast through the control device, the method comprising:

providing a first electrical current from the ballast to the control device; and adjusting the first current to provide a second current to the lamp, in which adjusting the first current comprises:

passing the first current through an inductive current divisor array;

controlling a commutable element to select between a first current path and a second current path in the inductive current divisor array, the first current path corresponding to a first luminosity setting, the second current path corresponding to a second luminosity setting; and heating an electrode of the lamp with the second current.

11. The method of claim 10 in which the first current path includes a loop through two inductive elements, and in which the second current path includes a shunt path to a terminal of the ballast.

12. The method of claim 11 in which the first luminosity setting is a higher luminosity setting, and in which the second luminosity setting is a lower luminosity setting.

13. The method of claim 11 in which controlling the commutable element comprises:

actuating a relay to select between the first current path and the second current path.

14. The method of claim 10 in which the first current path includes a loop through three inductive elements, and in which the second current path includes a shunt path to a terminal of the ballast.

15. The method of claim 14 in which controlling the commutable element comprises:

actuating a first relay to select between the first current path and the second current path; and actuating a second relay to select or deselect one of the three inductive elements.

16. The method of claim 10 in which the first luminosity setting is a higher luminosity setting, and in which the second luminosity setting is a lower luminosity setting, further in which the first luminosity setting corresponds to the second current being no more than a nominal capacity of the lamp.

17. The method of claim 10 further comprising:

receiving a control signal that indicates one of the first luminosity setting and the second luminosity setting; and selecting one of the first luminosity setting and the second luminosity setting in response to the control signal.

18. A lighting assembly comprising:

a rapid start ballast;

a luminosity control device; and a plurality of lamps, in which the plurality of lamps and the luminosity control device are connected in series to the rapid start ballast, the luminosity control device including:

an inductive current divisor array receiving a first current from the rapid start ballast and outputting a second current that flows through the lamps;

a commutable element in connection with the inductive current divisor array, the commutable element selecting between a first current path that creates a loop including a plurality of inductors in the inductive current divisor array and a second current path that connects the plurality of inductors to a terminal of the ballast distal the luminosity control device; and a transformer configured to provide heating to an electrode in at least one of the lamps during normal operation of the lighting assembly.

19. The lighting assembly of claim 18 further comprising:

a photosensor in connection with the luminosity control device, the photosensor providing a control signal to the luminosity control device in response to detected light, further in which the luminosity control device includes a controller receiving the control signal and causing the commutable element to select the first or the second current path responsive to the control signal.

20. The lighting assembly of claim 18 further comprising:

a motion sensor that sends a control signal to the luminosity control device indicating motion, further in which the luminosity control device includes a controller receiving the control signal and causing the commutable element to select the first or the second current path responsive to the control signal.

* * * * *

UNITED STATES PATENT AND TRADEMARK OFFICE

CERTIFICATE OF CORRECTION

PATENT NO. : 8,754,591 B2
APPLICATION NO. : 13/226253
DATED : June 17, 2014
INVENTOR(S) : Vicente Humberto Aldape Ayala et al.

It is certified that error appears in the above-identified patent and that said Letters Patent is hereby corrected as shown below:

On the Title Page, Column 1, item (75), Inventors - the first inventor's name needs to be corrected:

change data reading:
"Vincente Humberto Aldape Ayala"

to read:
--Vicente Humberto Aldape Ayala--

On the Title Page, Column 2, item (57) Abstract, lines 4-5 need to be corrected:

change data reading:
"start ballast and the lamp, a current divisor array, in connec-
tion with the first terminal and the second terminal, with a"

to read:
--start ballast and the lamp, a current divisor array, in commun-
ication with the first terminal and the second terminal, with a--

Signed and Sealed this
Seventh Day of October, 2014

Michelle K. Lee

Michelle K. Lee
*Deputy Director of the United States Patent and Trademark Office*